United States Patent [19]

Klees

[11] Patent Number: 4,497,422

[45] Date of Patent: Feb. 5, 1985

[54] POURING CAP

[76] Inventor: Garry W. Klees, 9130 SE. 72nd Pl., King County, Wash. 98040

[21] Appl. No.: 507,091

[22] Filed: Jun. 23, 1983

[51] Int. Cl.[3] ..... B67D 3/00

[52] U.S. Cl. ..... 222/482; 222/519; 222/548; 222/568

[58] Field of Search ..... 222/478, 481, 482, 484, 222/488, 489, 519, 520, 521, 553, 566, 567, 568, 573, 544, 548

[56] References Cited

U.S. PATENT DOCUMENTS

| | | | |
|---|---|---|---|
| 1,346,137 | 7/1920 | Silverthorne | 222/553 |
| 2,837,374 | 6/1958 | Lipman | 222/484 X |
| 3,067,916 | 12/1962 | Lerner | 222/519 |
| 3,197,090 | 7/1965 | Wallace | 222/519 |
| 3,384,276 | 5/1968 | Henningfield | 222/484 X |
| 3,439,843 | 4/1969 | Corsette | 222/568 X |
| 3,776,433 | 12/1973 | De Treitas | 222/519 |
| 4,065,037 | 12/1977 | Haller | 222/521 X |

*Primary Examiner*—Joseph J. Rolla
*Assistant Examiner*—Michael S. Huppert
*Attorney, Agent, or Firm*—Seed and Berry

[57] ABSTRACT

A two-piece spout and stopper for thin, volatile liquids, including an adapter piece to be threaded onto the neck of a bottle and a spout piece which threads into the adapter piece. Vent and pouring holes are provided in widely spaced array. The threads are sealed but allowed to be wetted by the fluid when pouring liquid. The shape of the surfaces is such as to minimize surface adhesion or trapping of liquid when the spout is closed.

9 Claims, 5 Drawing Figures

POURING CAP

DESCRIPTION

TECHNICAL FIELD

This invention pertains to combined pouring spouts and stoppers for handling of thin liquids, particularly volatile liquid fuels.

BACKGROUND ART

Containers for handling thin liquids have generally been provided with one cap or stopper for sealing the liquid in the container and a separate pouring spout which is substituted for the stopper when it is desired to pour the liquid from the container. This is particularly true in containers which store volatile liquid fuels, such as camping stove gasoline. Frequently, particularly for backpacking stove liquid fuel bottles, the pouring spout is tied with a piece of string to the stopper to avoid being lost. The necessity of having two pieces, one which must be completely substituted for the other, is an inconvenience and added expense.

It is important that no trapped or residual quantities of volatile liquid be able to leak out of the stopper or the spout when the fuel bottle is placed into a backpack or other storage location. Even a fraction of a teaspoon of the fuel, if it leaks into the backpack, will create unpleasant odors and perhaps an unsafe condition.

Various types of combined pouring spouts and stoppers for liquid storage bottles are described in patent literature. U.S. Pat. No. 3,067,916 discloses a one-piece cap. This one-piece cap, however, does not adequately seal against leakage of liquid and requires a specially designed bottle for its use. Furthermore, if volatile liquid is being poured, the cap shown in this patent will trap quantities of the volatile liquid which will be free to leak out of the cap at a later period.

Other types of caps have been designed for dispensing of thick liquids. A typical dispensing cap is shown in U.S. Pat. No. 4,065,037. This type of cap, however, frequently is not provided with vent openings and has numerous locations for trapping liquids. Furthermore, since only thick liquids are being dispensed, there are frequently inadequate seals provided around the threads, making them unusable for thin liquids.

Other types of caps are typified by U.S. Pat. No. 3,776,433. This type of cap is primarily used for pouring coffee or other hot, thin liquids into a wide-mouthed container, such as a coffee mug. One difficulty with this type of cap, if used for more volatile fluids, is that the threads are sealed internally so that no liquid can reach the threads. This is undesirable for plastic parts as these threads will bind, particularly if both threaded parts are of plastic. Furthermore, the sealing to prevent leakage out of the bottle is simply two plastic surfaces, which is not adequate for thin liquids and is particularly undesirable for volatile thin liquids.

DISCLOSURE OF INVENTION

It is an object of this invention to provide a two-piece stopper and pouring spout that is threaded together as an integral unit and which gives an optimum pouring flow, lubricates the threads between the two pieces, and seals the liquid against leakage from the bottle or from any trapped recesses between the two pieces.

Another object of this invention is to provide an improved and convenient combined pouring spout and stopper for thin liquids, particularly highly volatile thin liquids, such as liquid fuels.

It is still another object of this invention to provide an inexpensive, injection-molded plastic, combined pouring spout and stopper for thin liquid fuels.

Basically, these objects are obtained by providing an adapter piece or member which is threaded onto the neck of the liquid storage bottle. Appropriate seals are provided to prevent leakage between the bottle and the adapter piece. The adapter piece has an upstanding, internally threaded flange and is provided with pouring and vent holes. These pouring and vent holes are widely spaced so that vent air can reach the top surface of the liquid even when the bottle is tilted to pour the liquid at a steep angle. This spacing of the pour and vent holes eliminates the slow and disruptive type of pouring action known as "gurgling."

Threaded into the internally threaded upstanding flange of the adapter piece is a pouring piece or member. The pouring piece has external threads and an internal cavity formed of a vertical sidewall. One side of the sidewall terminates at its upper end in an elongated, laterally protruding pouring tube. Spaced from the pouring tube is a vent port. Again, the vent port and pouring tube are spaced so that a large angle of the bottle can be made without blocking the ingress of venting air to the bottle. The threads between the pouring piece and the adapter piece are sealed by an inner seal when the pouring piece is threaded tightly into the adapter piece to prevent leakage from between the threads. The threads are also sealed by an outer seal that is located at the outer ends of these threads so that liquid can reach the threads for lubrication when the two pieces are threaded away from each other during pouring. That is, the threads are intentionally wetted for lubrication purposes. The inner seal traps the lubrication liquid within the threads when the pouring piece is threaded inwardly of the adapter piece. Preferably, the inner seal also functions to seal the pouring and vent holes in the adapter piece to prevent leakage of liquid out of the bottle when the pouring piece is threaded tightly into the adapter piece.

As is readily apparent, the two pieces combine to form an ideal pouring spout and stopper which is convenient to use and effectively seals against leakage of liquid from the bottle. The space between the pouring and adapter pieces have a minimum of horizontal surfaces available to which the liquid can adhere. Those surfaces which do readily allow adherence of liquid or trapped liquid to accumulate are all sealed from the vent port or pouring tube when the pieces are closed so that even though the bottle may be inverted or shaken, no appreciable amount of volatile liquid can leave the bottle or leave the pieces.

The two pieces are preferably made of injection-molded plastic, making them inexpensive to manufacture.

BEST MODE FOR CARRYING OUT THE INVENTION

Figure 1:
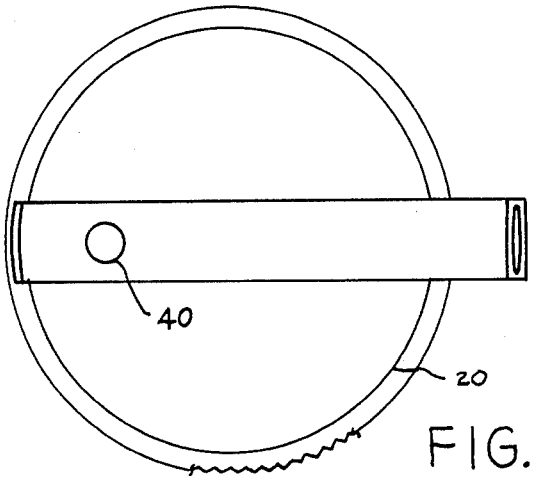
FIG. 1 is a top plan view of a combined pouring spout and stopper embodying the principles of the invention.

The combined pouring spout and stopper includes an adapter piece 10 having threads 11 which threadably engage an internally threaded bottle neck 12 of a storage container or bottle B. An elastomeric seal 14 seals between the adapter piece and the neck of the bottle.

The adapter piece is provided with four peripheral and circumferencially spaced openings. One or more of these openings will serve as vent holes 16, whereas one or more of the others will serve as pouring holes 18, depending upon the angle of repose of the liquid when being poured.

A pouring piece 20 is provided with external threads 22 that engage internal threads 24 on the adapter piece. An outer seal 26 is provided at the externally outer ends of the threads 22 and 24. Both the pouring piece and the adapter piece are preferably made of injection-molded plastic. The location of the seal 26 is intended to prevent leakage from between the two pieces, but lets fuel reach the threads 22 and 24 so that they will remain wetted and lubricated surfaces.

The pouring piece is provided with an internal cavity defined by a generally vertical sidewall 30. The sidewall terminates at a right-angle corner between the sidewall 30 and the bottom surface 32 of the pouring piece. A large elastomeric sealing ring 34 is provided in the bottom surface 32 of the pouring piece 20.

Figure 2:
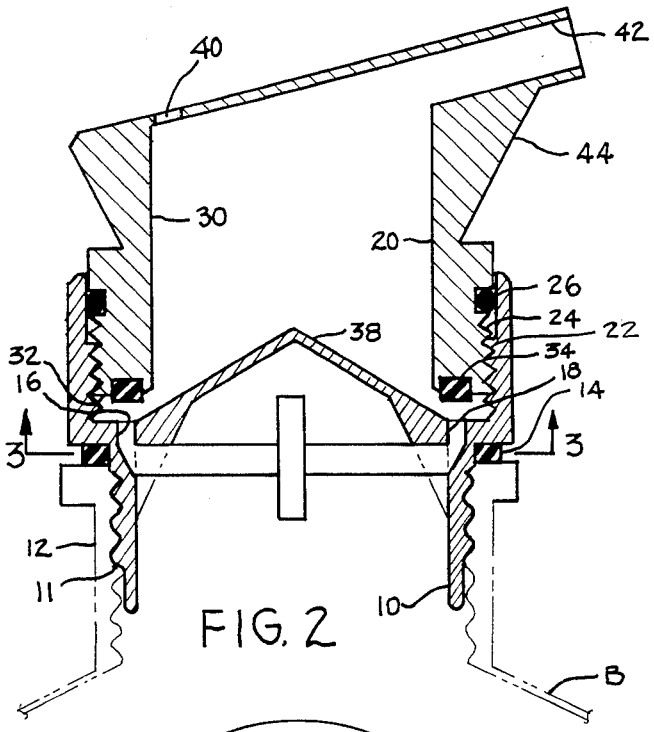
FIG. 2 is a vertical section of the spout and stopper shown in FIG. 1.
Figure 4:
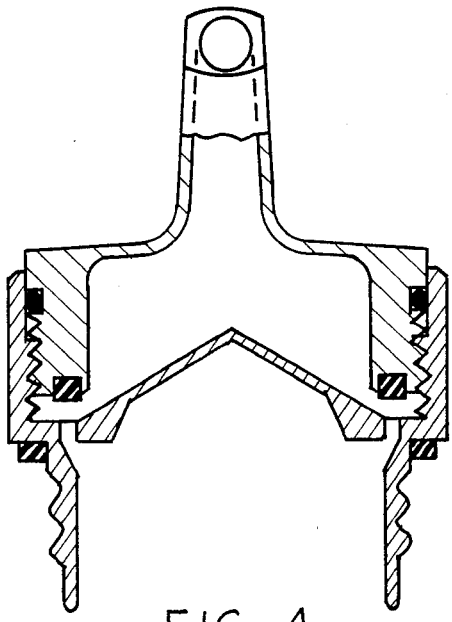
FIG. 4 is a vertical section at right angles to the section of FIG. 2.
Figure 3:
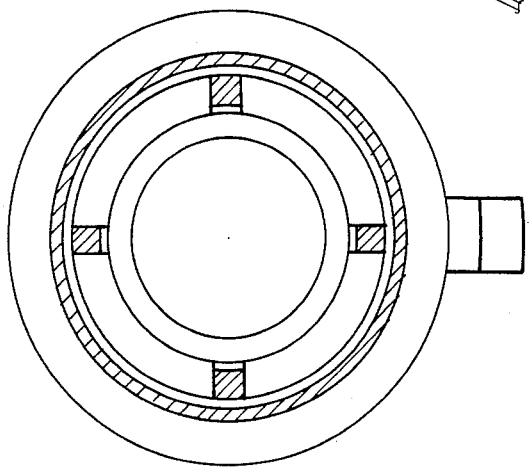
FIG. 3 is a section taken along a line 3—3 of FIG. 2.

As is best illustrated in FIG. 2, the surfaces between the sealing ring 34 and the upper end of the cavity 30 are either vertical or are very short, if horizontal. There are also no recesses or notches between the sealing ring 34 and the upper end of the cavity 30 which could trap liquid by surface adhesion. Since all of the surfaces are either vertical or are right-angle-type surfaces, it is very difficult for any liquid to adhere to these surfaces. Thus, when the pouring is completed and the bottle placed upright, the liquid will run through the pouring or vent holes back into the bottle rather than being trapped outside of the sealing ring 34.

The sealing ring 34 advantageously provides three sealing functions, although individual seals could also be provided. First, the sealing ring seals or traps any liquid in the threads 22 and 24 from leaving those threads when the pouring piece is closed (threaded down tightly toward the adapter piece). Secondly, the sealing ring 34 covers the pouring holes 18. Thirdly, the sealing ring covers the vent holes 16. Since the sealing ring overlies an angled surface 38 of the adapter piece, it wipes downwardly along that surface as the pouring piece is threaded into the adapter piece to provide a better seal.

The upper end of the cavity 30 terminates in a vent port 40 which is widely spaced from a pouring tube or channel 42. The tube extends laterally outwardly from the cavity 30 so that the tube can be placed into the narrow neck of the container into which the fuel is to be poured. The angled surface 44 below the pouring tube also conveniently provides a resting surface on the container into which the fuel is being poured to steady the bottle while the fuel is being poured.

Figure 5:
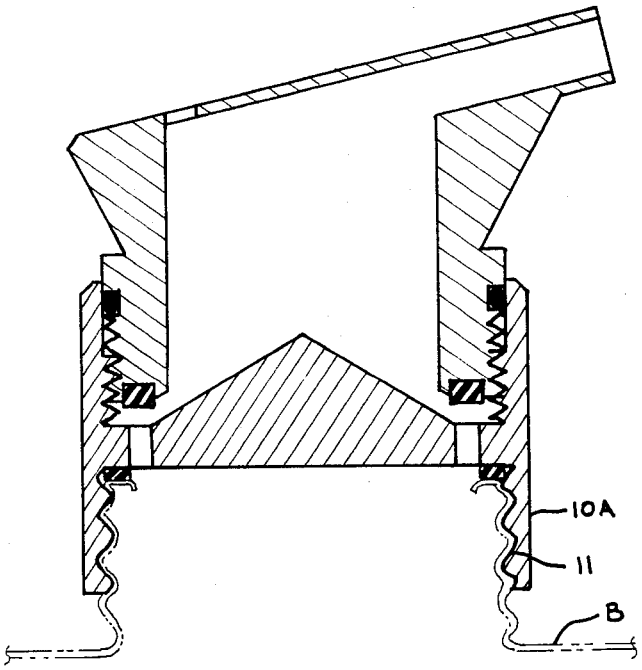
FIG. 5 is a modified embodiment adapted for externally threaded bottle necks.

FIG. 5 illustrates an embodiment identical to that of FIGS. 1–4, with the exception that the adapter piece 10A is provided with internal threads 11 to thread onto the external threads of a bottle B.

While the preferred embodiments of the invention have been illustrated and described, it should be understood that variations will be apparent to one skilled in the art without departing from the principles herein. Accordingly, the invention is not to be limited to the embodiments illustrated in the drawings.

I claim:

1. A combination pourer and stopper for thin, primarily volatile liquids, comprising:

a threaded adapter member, adapted to be sealingly coupled to the neck of a liquid bottle, said adapter member having radially, widely spaced pouring and vent holes through which the liquid can leave the bottle and air can enter the bottle, respectively, a pouring member threaded into said adapter member, said pouring member having a pouring spout and a vent port, the vent port being widely spaced from the pouring spout and the pouring spout generally overlying the pouring hole of the adapter member, the pouring member having an externally threaded flange and having a cavity defined by a generally vertical internal wall for reducing surface adhesion of liquid within the pouring member, sealing means for selectively sealing threads of the flange from the pouring spout for precluding movement of liquid from the threaded flange to the pouring spout but allowing access by the liquid to the threads for lubrication when unsealed, and sealing means responsive to axially inward movement of the pouring member for selectively sealing the pouring and vent holes for precluding, when sealed, movement of liquid out of said bottle.

2. The combination of claim 1, said pouring spout having an elongated narrow channel and protruding radially outwardly of the internal, generally vertical wall for guiding liquid in a confined stream out of said pouring member, said pouring spout including a lower lip for resting the spout on the container to be filled for steadying the flow.

3. The combination of claim 1 wherein the members are plastic and are injection molded, and wherein all substantial surfaces in the pouring member cavity are vertical to drain rapidly with minimal horizontal surfaces or indented corners.

4. The combination of claim 1, said threaded flange sealing means and said pouring and vent hole sealing means comprising a single annular sealing ring secured to said pouring member, whereby threading of the pouring member axially inwardly simultaneously seals the external threads, the pouring hole and the vent hole.

5. The combination of claim 1, said adapter member having bottle-engaging threads on an outside surface.

6. The combination of claim 1, said adapter member having bottle-engaging threads on an inside surface.

7. The combination of claim 1, said adapter member having an axially upstanding threaded lip opposed to said pouring member threaded flange, an outer sealing member for sealing the outer ends of said threaded lip and threaded flange to preclude movement of liquid outwardly of said lip and flange, and a bottle-sealing member located between the neck of the bottle and the adapter member to preclude movement of liquid outwardly between the bottle and the adapter member.

8. The combination of claim 7, said threaded flange first sealing means and said pouring and vent hole second sealing means comprising a singular annular seal secured to said pouring member, whereby threading of the pouring member inwardly simultaneously seals the external threads of the pouring member and the pouring hole and the vent hole of said adapter member to preclude movement of liquid outwardly between the bottle and the adapter member.

9. A combination pourer and stopper for thin, volatile liquid fuels, comprising an adapter piece adapted to be threadably secured to the neck of a fuel bottle, means for sealing the threads between the adapter piece and the bottle, said adapter piece having an upstanding, peripheral, internally threaded flange and widely, radially spaced pouring and vent holes, a pouring piece having external threads engaging said internal threads of said adapter piece flange, means for sealing the threads between the adapter piece and the pouring piece against leakage of liquid from between the engaged external and internal threads but being located to allow wetting of said threads for lubrication when liquid is being poured, said pouring piece having a pouring tube and a vent, said vent port being widely spaced from said pouring tube, said pouring tube extending laterally outward of said pouring piece to guide the liquid into a narrowly confined flow, and one-piece sealing means carried by said pouring piece to close said pouring and vent holes and seal the inner ends of the threads between the adapter piece and the pouring piece so that fuel cannot leak from said threads or said holes.

* * * * *